US009055773B2

(12) United States Patent
Crye

(10) Patent No.: US 9,055,773 B2
(45) Date of Patent: Jun. 16, 2015

(54) LIGHTWEIGHT EQUIPMENT CARRYING GARMENT

(75) Inventor: Caleb Clark Crye, Brooklyn, NY (US)

(73) Assignee: LINEWEIGHT LLC, Brooklyn, NY (US)

( * ) Notice: Subject to any disclaimer, the term of this patent is extended or adjusted under 35 U.S.C. 154(b) by 603 days.

(21) Appl. No.: 13/005,980

(22) Filed: Jan. 13, 2011

(65) Prior Publication Data

US 2012/0180189 A1 Jul. 19, 2012

(51) Int. Cl.

| | |
|---|---|
| ***F41H 1/02*** | (2006.01) |
| ***A41D 13/00*** | (2006.01) |
| ***A45F 5/02*** | (2006.01) |
| *A45F 3/14* | (2006.01) |

(52) U.S. Cl.

CPC ..... *A41D 13/0007* (2013.01); *A45F 3/14* (2013.01); *A45F 5/02* (2013.01)

(58) Field of Classification Search

USPC ..... 2/93, 94, 102, 103, 2.5, 253, 265, 462, 2/321, 247, 248; 24/3.7, 578.13; 224/675, 228; 441/106, 88; 182/3; 434/254; 254/250–251

See application file for complete search history.

(56) References Cited

U.S. PATENT DOCUMENTS

| | | | | |
|---|---|---|---|---|
| 4,936,805 | A * | 6/1990 | Piatt, Jr. | 441/106 |
| D375,404 | S * | 11/1996 | Moffitt | D3/228 |
| 5,603,648 | A * | 2/1997 | Kea | 441/106 |
| 5,724,707 | A | 3/1998 | Kirk et al. | |
| 6,108,816 | A | 8/2000 | Bradley | |
| 6,948,188 | B2 * | 9/2005 | D'Annunzio | 2/102 |
| 7,200,871 | B1 | 4/2007 | Carlson | |
| D549,959 | S * | 9/2007 | Wood et al. | D3/228 |
| 7,424,748 | B1 * | 9/2008 | McDunn et al. | 2/2.5 |
| 7,448,115 | B2 | 11/2008 | Howell et al. | |
| 7,644,449 | B2 | 1/2010 | Hellweg | |
| 8,011,545 | B2 * | 9/2011 | Murdoch et al. | 224/672 |
| 8,079,503 | B1 * | 12/2011 | Yeates et al. | 224/666 |
| 2002/0120973 | A1 * | 9/2002 | D'Annunzio | 2/92 |
| 2005/0005343 | A1 * | 1/2005 | Johnson | 2/102 |
| 2005/0015944 | A1 * | 1/2005 | Bergeron | 24/584.1 |
| 2006/0162135 | A1 | 7/2006 | Howell et al. | |
| 2006/0242799 | A1 * | 11/2006 | Flossner | 24/3.7 |
| 2008/0115332 | A1 * | 5/2008 | Kopp | 24/3.7 |
| 2008/0235841 | A1 * | 10/2008 | McDunn et al. | 2/2.5 |
| 2008/0242170 | A1 * | 10/2008 | Marshall | 441/106 |
| 2008/0295210 | A1 * | 12/2008 | Matic et al. | 2/2.5 |
| 2009/0307878 | A1 | 12/2009 | Kadas | |
| 2010/0205708 | A1 * | 8/2010 | Storms et al. | 2/2.5 |

(Continued)

OTHER PUBLICATIONS

Spec_Ops_10-26-2010small.pdf "Photograph of rear of SPEC-OPS brand Molle Accessory".

*Primary Examiner* — Shaun R Hurley
*Assistant Examiner* — Andrew W Sutton
(74) *Attorney, Agent, or Firm* — Stiennon & Stiennon

(57) ABSTRACT

A MOLLE system compatible garment has a lightweight attachment structure with a skeleton of horizontal bands connected by a few vertical bands. The horizontal bands are thus accessible from both the interior and the exterior permitting accessories to be attached to either side of the garment. The bands may be sewn with regularly spaced vertical seams to each other or to a plastic substrate. The horizontal bands are connected with supportive vertical bands which serve to retain the shape of the garment, and which do not interfere with the regularly spaced loops of the horizontal webbing bands. Conventional accessories can be attached to both the interior and the exterior of the garment.

16 Claims, 3 Drawing Sheets

(56) References Cited

U.S. PATENT DOCUMENTS

2010/0287681 A1* 11/2010 Storms et al. ..... 2/102
2011/0023207 A1* 2/2011 Storms et al. ..... 2/102
2011/0209260 A1* 9/2011 Herbener et al. ..... 2/2.5
2012/0042439 A1* 2/2012 Dyster et al. ..... 2/311
2012/0174276 A1* 7/2012 Craffey ..... 2/2.5
2012/0180178 A1* 7/2012 Gallo ..... 2/2.5
2012/0185988 A1* 7/2012 Herbener et al. ..... 2/2.5

* cited by examiner

LIGHTWEIGHT EQUIPMENT CARRYING GARMENT

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to garments generally, and more particularly to lightweight utility garments which can accommodate various accessory elements.

Many active occupations require that practitioners have any number of specialized tools, supplies, and materials on their persons for ready use at any time. Soldiers and police officers, for example, must carry weapons, ammunition, lights, food and beverage, etc. Yet in most situations there is a desire to avoid the carriage of extraneous items which might unnecessarily reduce the speed, agility, and endurance of the carrier. Hence it is desirable that accessories be capable of speedy attachment and removal from the wearer's garment.

Various accessory systems are known for attaching pouches and other elements to belts, vests, or other garments. A standardized attachment system employed by US military services is the U.S. Army's PALS (Pouch Attachment Ladder System) arrangement. This system can be provided on a belt or a vest, and employs horizontal rows of 1" Mil-W-43668 Type III nylon webbing spaced 1" apart, and attached to a backing fabric panel at 1.5" intervals. The PALS webbing defines an array of upwardly and downwardly opening loops. Pouches, pockets, holsters, and other accessories may be attached to the loops. Commonly, the PALS system is a component of a supporting vest such as those which are a part of the US Army's MOLLE (MOdular Lightweight Load-carrying Equipment) system.

Conventional MOLLE vests can interact with a wide variety of accessories and attachments which are configured for use with this standard arrangement of attachment points. Accessories attach to the loops with various hooks, straps or fasteners which engage with one or more loops. However, for the comfort and endurance of the wearer, it is desirable to reduce the weight of garments as much as possible.

SUMMARY OF THE INVENTION

The equipment carrying garment of the present invention offers a lightweight attachment structure which minimizes the material used by reducing the garment to a skeleton of horizontal bands connected by a few vertical bands. The garment may have a bearing frame assembly with horizontal and vertical bands. The horizontal bands may be comprised of woven webbing bands secured to each other at regularly spaced lines of attachment to form upwardly opening loops which can be accessed from both the interior and the exterior of the garment. The horizontal bands are connected with supportive vertical bands which serve to retain the shape of the garment, and which do not interfere with the regularly spaced loops of the horizontal webbing bands. A plastic substrate may be positioned between horizontal bands at the same level to provide additional stiffness. The garment permits attachment of conventional accessories and elements to both the interior and the exterior of the garment, while eliminating the weight and bulk of a continuous backing layer.

It is an object of the present invention to provide a load supporting garment which is compatible with the MOLLE system which is very lightweight.

It is a further object of the present invention to provide a load supporting garment which is capable of supporting accessories on the interior and the exterior of the garment.

Further objects, features and advantages of the invention will be apparent from the following detailed description when taken in conjunction with the accompanying drawings.

DESCRIPTION OF THE PREFERRED EMBODIMENTS

Figure 1:
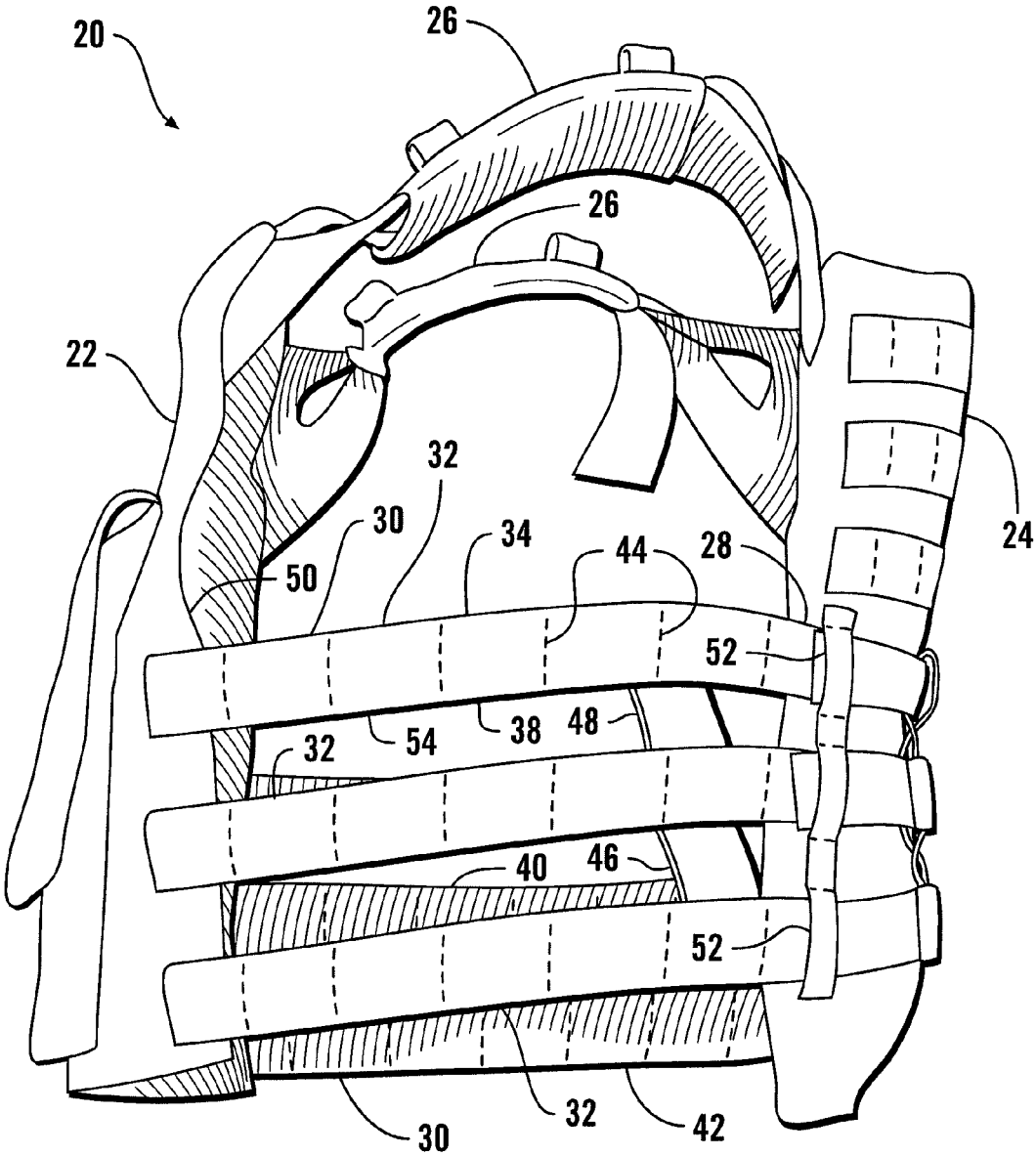
FIG. 1 is a perspective view of the lightweight equipment carrying garment of the present invention.
Figure 2:
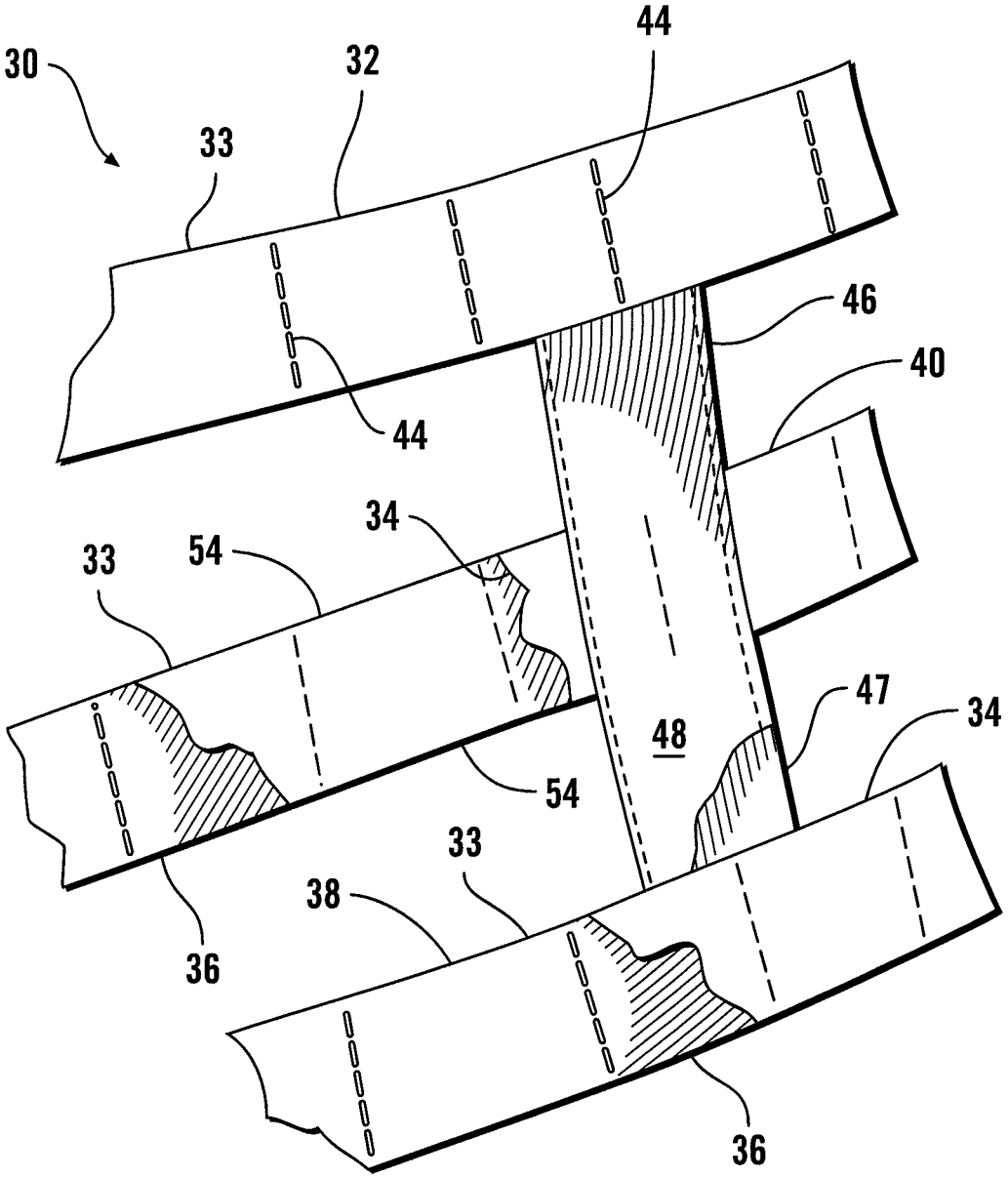
FIG. 2 is an enlarged fragmentary side view, partially cut away in section, of a portion of the garment of FIG. 1.

Referring more particularly to FIGS. 1-4, wherein like numbers refer to similar parts, an equipment carrying garment 20 is shown in FIGS. 1 and 2. The garment 20 is a vest with a front segment 22 joined to a rear segment 24 by two shoulder straps 26, and with a lower torso encircling cummerbund portion 28. These elements are arranged to engage a wearer and to support the garment thereon. The cummerbund portion 28 has two flexible bearing frame assemblies 30 which extend between the vest front segment 22 and rear segment 24, one of the assemblies on the left side of the user, and one on the right side.

Figure 3:
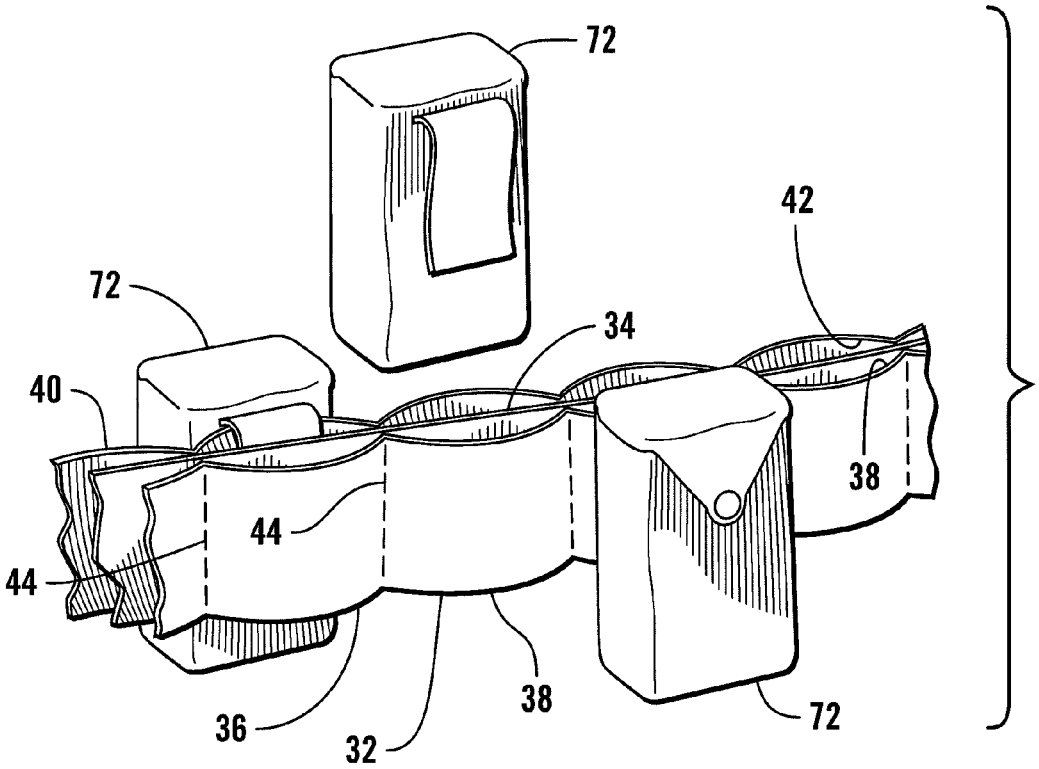
FIG. 3 is a fragmentary exploded isometric view of the garment of FIG. 1 together with accessories attached thereto.

Each bearing frame assembly 30, as shown in FIG. 1, has a plurality of horizontal bands 32 which extend between the front segment 22 and the rear segment 24. Each horizontal band, as shown in FIGS. 2 and 3, is made up of a substrate 34 to which an exterior layer 36 is secured at regularly spaced intervals to define a plurality of exterior loops 38, and to which an interior layer 40 is secured at the same regularly spaced intervals to define a plurality of interior loops 42. The substrate 34 may be formed of TEGRIS® material, a polypropylene thermoplastic composite with excellent impact resistance and stiffness and lightweight composition, manufactured by Milliken & Company of Spartanburg, S.C. The exterior and interior layers 36, 40 may be conventional woven 1 inch nylon webbing. The exterior and interior layers 36, 40 are secured to the substrate 34 by vertical regions of connection such as stitched seams 44, the seams being 1.5 inches apart.

At least one vertical band 46 is secured to all the horizontal bands 32. The vertical band 46 helps to retain the horizontal bands 32 at a spacing of one-inch apart. The vertical band 46 is comprised of an internal substrate 47, similar to the substrate 34, to which an interior layer and an exterior layer 48 of nylon webbing is sewn. One of the vertical stitched seams 44 on each horizontal band 32 extends through the centerline of the vertical band 46, as shown in FIG. 2. Thus the vertical band 46 does not interfere with access to the exterior or interior loops 38, 42 adjacent the vertical band.

As shown in FIG. 1, the horizontal bands 32 may be fixed or adjustably connected to the front segment 22 and rear segment 24 of the garment 20, for example being sewn to a vertical segment of material 50 or being received within fixed vertically spaced, horizontally opening loops 52, allowing the adjustment of the cummerbund in various fashions.

Each bearing frame assembly 30 is thus a skeleton of horizontal bands with interior and exterior loops, the spacing therebetween being maintained at intervals by at least one vertical band and the end attachments of the bearing frame assembly. The bearing frame assembly presents all the attachment points of a PALS system, but eliminates much of the backing fabric typically found in a MOLLE system garment, hence offering reduced overall weight and improved air circulation. Moreover, because horizontal through openings 54 are defined between the horizontal bands, accessories 72 are readily mounted to the interior or the exterior of the bearing frame assembly 30. For example, a ballistic protective plate, not shown, could be mounted to the interior in a military application, while a pouch, holster, or other accessory could be mounted to the exterior directly over the ballistic protective plate. The accessory 72 may be similar to the one shown in my Publication No. US-2009-0084822-A1, entitled Accessory Attachment System, the disclosure of which is incorporated by reference herein. In a preferred embodiment, the horizontal bands are one inch tall, spaced vertically one inch from adjacent horizontal bands, and the loops are defined by the regions of connection such as seams spaced 1.5 inches apart, making the carriage system fully compatible with MOLLE components intended for attachment to PALS webbing. Thus the distance between the upper perimeter 33 of one horizontal band 32 to the upper perimeter of the next lower horizontal band is about 2 inches. It should be noted that the height of the bands, and the height of the space between bands may be varied, so long as the 2-inch spacing between the upper perimeters of the bands is preserved, thus maintaining compatibility with MOLLE components.

There are many accessories designed for attachment to prior art MOLLE-compatible garments, and using a variety of clips, straps and fasteners to engage the conventionally spaced PALS webbing. Often accessories will engage with more than one loop of the PALS webbing to stabilize, position, or support a larger item. Although the arrangement of this invention can be light in weight, and adaptable to receiving accessories on both the interior and the exterior of the garment, because it retains the pocket size and positioning of a conventional MOLLE-compatible garments, it retains the ability to receive those accessories which are designed for pre-existing garments. Some accessories use two or more side-by-side loops, some use multiple loops spaced vertically.

Figure 4:
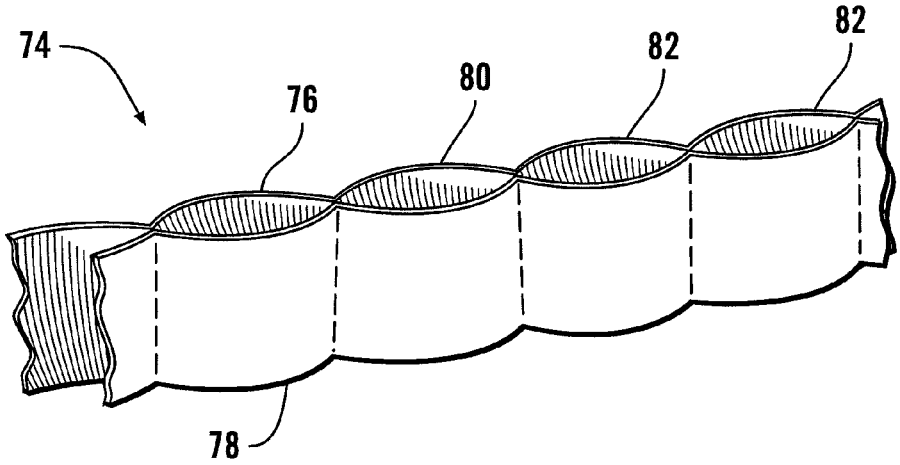
FIG. 4 is a fragmentary perspective view of an alternative embodiment lightweight equipment carrying garment of this invention.

An alternative embodiment garment 74, a portion of which is shown in FIG. 4, is similar to the garment 20 described above, but has horizontal bands 76 comprised of an exterior layer 78 sewn to an interior layer 80 with no intermediate substrate. This is achieved by using a heavier or otherwise stiffer material for the layers 78, 80, which provides the level of support desired. The alternative embodiment garment 74 still allows loops 82 which are defined between the layers 78, 80, to be accessed from either the interior or exterior sides of the garment.

In another alternative embodiment garment, similar in appearance to the one illustrated in FIG. 4, one of the interior or exterior layers is itself composed of a stiffening plastic material such as TEGRIS® material, discussed above.

It should be noted that although the bearing frame assemblies have been disclosed as extending between the front and rear segments of a vest, a bearing frame assembly may be disposed elsewhere on a garment, for example on the front or rear thereof.

As an alternative to connecting two strips of webbing by sewing to define sewn seams, the webbing may also be formed in the weaving process to have two interwoven strips joined at defined intervals, for example, 1.5 inch spacing. Thus the regions of connection are formed integrally rather than by sewing.

It is understood that the invention is not limited to the particular construction and arrangement of parts herein illustrated and described, but embraces all such modified forms thereof as come within the scope of the following claims.

I claim:

1. A load supporting garment having an exterior facing away from a wearer and an interior facing towards the wearer, the garment comprising:

elements arranged to engage a wearer and to support the garment thereon, the elements comprising a front segment for positioning forward of the wearer and a rear segment for positioning rearwardly of the wearer; and a bearing frame assembly connected between the front segment and the rear segment, the bearing frame assembly having a first horizontal band spaced vertically from a second horizontal band, with at least one vertical band extending between and attached to the two horizontal bands, wherein each horizontal band has an exterior and an interior, and wherein an opening is defined between the two horizontal bands through which the exterior and the interior of the bands is accessible from the garment interior and from the garment exterior, wherein each horizontal band is comprised of a plurality of layers, connected to each other to define upwardly and downwardly opening loops which are accessible from the interior and the exterior.

2. The load supporting garment of claim 1 wherein the plurality of layers of each horizontal band comprise:

a substrate;

an exterior layer secured to the substrate at regularly spaced intervals to define a plurality of exterior loops; and an interior layer secured to the substrate at said regularly spaced intervals to define a plurality of interior loops.

3. The load supporting garment of claim 2 wherein the at least one vertical band is secured to the substrate so that portions of two exterior loops are accessible and portions of two interior loops are accessible adjacent the at least one vertical band.

4. The load supporting garment of claim 1 wherein the plurality of layers of each horizontal band comprise:

a substrate; and an exterior layer adhered to the substrate.

5. The load supporting garment of claim 1 wherein the plurality of layers of each horizontal band comprise:

an exterior layer; and an interior layer secured directly to the exterior layer at regularly spaced intervals to define the upwardly and downwardly opening loops.

6. The load supporting garment of claim 1 wherein the first horizontal band has an upper perimeter, and the second horizontal band has an upper perimeter, and wherein said horizontal band upper perimeters are spaced vertically from one another two inches, and the upwardly and downwardly opening loops are joined at regions of connection spaced 1.5 inches apart, such that the garment is compatible with MOLLE components intended for attachment to PALS webbing.

7. The load supporting garment of claim 1 wherein the elements arranged to engage a wearer and to support the garment thereon comprise:

two shoulder straps which extend between and connect the front segment to the rear segment.

8. A load supporting garment having an exterior facing away from a wearer and an interior facing towards the wearer, the garment comprising:

elements arranged to engage a wearer and to support the garment thereon, the elements comprising a front segment for positioning forward of the wearer and a rear segment for positioning rearwardly of the wearer; and a bearing frame assembly connected between the front segment and the rear segment, the bearing frame assembly having a first horizontal band; and a second horizontal band connected to the first horizontal band to define a horizontal opening therebetween;

at least one upwardly extending band extending between and attached to the first horizontal band and the second horizontal band, wherein each of the first horizontal band and the second horizontal band is comprised of at least two layers which overlie one another, with a plurality of vertically extending regions of connection formed thereon to define a plurality of upwardly and downwardly opening loops, the loops being accessible from an interior on the side of one of the at least two layers, and an exterior on the side of the other of the at least two layers, wherein accessories may be attached to the bearing frame assembly from the exterior of the garment and the interior of the garment.

9. The load supporting garment of claim 8 wherein the at least two layers of each horizontal band comprise:

a substrate;

an exterior layer secured to the substrate by the regions of connection at regularly spaced intervals to define a plurality of exterior loops; and an interior layer secured to the substrate by the regions of connection at said regularly spaced intervals to define a plurality of interior loops.

10. The load supporting garment of claim 9 wherein the first horizontal band is connected to the second horizontal band by the at least one upwardly extending vertical band which is secured to the substrate so that portions of two exterior loops are accessible and portions of two interior loops are accessible adjacent the at least one vertical band.

11. The load supporting garment of claim 8 wherein each horizontal band comprises:

an exterior layer; and an interior layer secured directly to the exterior layer at regularly spaced intervals to define the upwardly and downwardly opening loops.

12. The load supporting garment of claim 8 wherein the first horizontal band has an upper perimeter, and the second horizontal band has an upper perimeter, and wherein said horizontal band upper perimeters are spaced vertically from one another two inches, and the upwardly and downwardly opening loops are defined by regions of connection spaced 1.5 inches apart, such that the garment is compatible with MOLLE components intended for attachment to PALS webbing.

13. The load supporting garment of claim 8 wherein the elements arranged to engage a wearer and to support the garment thereon comprise:

two shoulder straps which extend between and connect the front segment to the rear segment.

14. A load supporting garment and a MOLLE accessory, the garment having an exterior facing away from a wearer and an interior facing towards the wearer, the garment and the MOLLE accessory, comprising:

elements arranged to engage a wearer and to support the garment thereon, the elements comprising a front segment for positioning forward of the wearer and a rear segment for positioning rearwardly of the wearer;

a bearing frame assembly connected between the front segment and the rear segment, the bearing frame assembly having a first horizontal band having an upper perimeter and having two layers which overlie one another and which are connected by a plurality of vertical regions of connection spaced 1.5 inches apart to define a plurality of upwardly and downwardly opening loops;

a second horizontal band having an upper perimeter and having two layers which overlie one another and which are connected by a plurality of vertical regions of connection spaced 1.5 inches apart to define a plurality of upwardly and downwardly opening loops, wherein the second horizontal band upper perimeter is spaced two inches below the first horizontal band upper perimeter to define a horizontal opening therebetween, wherein the loops are accessible from the garment interior on the side of one of the at least two layers, and the garment exterior on the side of the other of the at least two layers, wherein accessories may be attached to the bearing frame assembly from the exterior and the interior of the garment;

at least one upwardly extending band extending between and attached to the first horizontal band and the second horizontal band; and a MOLLE accessory connected to at least one of the loops of the bearing frame assembly on the garment interior or the garment exterior.

15. The load supporting garment and MOLLE accessory of claim 14 wherein the first horizontal band and the second horizontal band each comprise:

a substrate;

an exterior layer secured to the substrate by the regions of connection at regularly spaced intervals to define a plurality of exterior loops; and an interior layer secured to the substrate by the regions of connection at said regularly spaced intervals to define a plurality of interior loops.

16. The load supporting garment and MOLLE accessory of claim 14 wherein the elements arranged to engage a wearer and to support the garment thereon comprise:

two shoulder straps which extend between and connect the front segment to the rear segment.

* * * * *